United States Patent [19]

Mortel et al.

[11] 4,382,362

[45] May 10, 1983

[54] EXTERNAL COMBUSTION ENGINE

[76] Inventors: Antonius M. Mortel; Peter J. Mortel; Henry F. Mortel; Anthony F. Mortel; Frederick H. Mortel, all of 70 Austral St., Kogarah, New South Wales 2217, Australia

[21] Appl. No.: 180,599

[22] Filed: Aug. 25, 1980

[51] Int. Cl.[3] ..... F02G 1/02

[52] U.S. Cl. ..... 60/517; 60/522

[58] Field of Search ..... 60/517, 525, 526, 522

[56] References Cited

U.S. PATENT DOCUMENTS

| | | | |
|---|---|---|---|
| 3,180,078 | 4/1965 | Liston | 60/526 |
| 3,812,677 | 5/1974 | Greis | 60/517 |
| 4,136,523 | 1/1979 | Pronovost | 60/517 |

*Primary Examiner*—Allen M. Ostrager

*Attorney, Agent, or Firm*—Buell, Blenko, Ziesenheim & Beck

[57] ABSTRACT

A Stirling cycle engine having a reciprocating power piston and a reciprocating displacer operating in cylinders having ports covered and uncovered by the motion of the piston and displacer. Ports of the power piston cylinder are connected to ports of the displacer cylinder through cooling means arranged to cool the working fluid.

Various drive linkages are described which enable the motions of the power piston and the displacer to closely conform to the ideal Stirling cycle.

11 Claims, 8 Drawing Figures

EXTERNAL COMBUSTION ENGINE

The present invention relates to an external combustion engine and has been devised particularly for use on the Stirling cycle.

The Stirling cycle is a well known theoretical cycle for an external combustion engine which is very highly efficient and is able to make use of a wide range of fuels. Attempts have been made to put the Stirling cycle into operation in a number of different ways, most of which use a reciprocating power piston and a reciprocating displacer to feed heated and cooled gases to and from the piston chamber. It is a disadvantage of external combustion engines attempting to operate on the Stirling cycle that the linkage between the reciprocating piston and the reciprocating displacer is such that it has been difficult to attain the timing of gas transfer to approach the ideal theoretical Stirling cycle.

The common external combustion engine has a cycle of compression expansion and fluid reverse with the inherant disadvantage that the fluid once heated must repass through the heater before entering the regenerator and the cooler. The power stroke is ineffective as the first quarter of the stroke is negative and the last quarter is very weak.

It is therefore an object of the present invention to provide a Stirling cycle engine which will obviate or minimise the foregoing disadvantages in a simple yet effective manner.

Accordingly, in one aspect, the invention consists in a Stirling cycle engine having at least one power piston reciprocating in a cylinder and at least one displacer piston also reciprocating in a cylinder wherein the walls of each cylinder are provided with ports which are covered and uncovered by movement of the piston therein, at least one port of the power piston cylinder being connected to at least one port of the displacer piston cylinder by a conduit incorporating cooling means arranged to cool the working fluid passing through said conduit.

In a further aspect the invention consists in a Stirling cycle engine having a reciprocating piston and a reciprocating displacer, having their reciprocating axes arranged in a V-configuration on a common crank-case incorporating a first crank-shaft and a second parallel crank-shaft geared to rotate at twice the speed of said first crank-shaft, said piston being connected to said first crank-shaft by a connecting rod to an off-set crank thereon and said displacer being connected to an intermediate point on a yoke having one end connected to a crank on said first crank-shaft and the other end connected to a crank on said second crank-shaft.

Notwithstanding any other forms that may fall within its scope, one preferred form of the invention and variations thereof will now be described with reference to the accompanying drawings in which.

Figure 1:
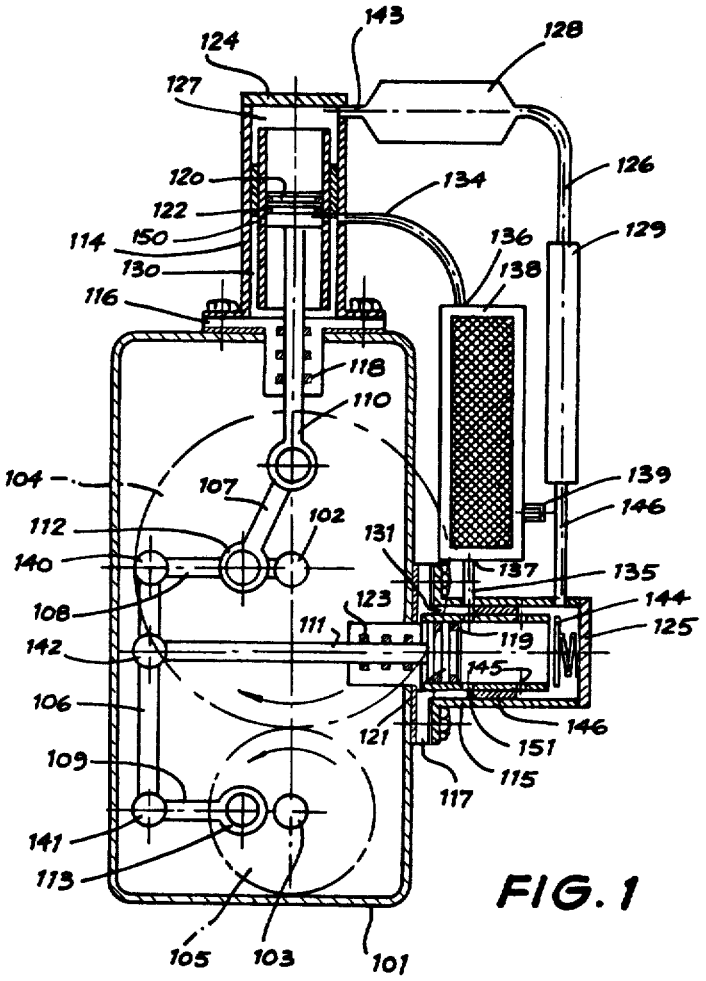
FIG. 1 is a diagrammatical cross-sectional view of a Stirling cycle engine according to the invention.

In the present preferred form of the invention a Stirling cycle engine and variations thereof are constructed as follows:

Referring to FIG. 1 the engine is provided with a crank-case 101 on which is mounted cylinders 114 and 115 incorporating a reciprocating power piston 120 and a reciprocating displacer piston 121, respectively. The cylinders are mounted on the crank-case in a V-configuration and in the preferred form of the invention the angle between the reciprocating axis of the piston and the reciprocating axis of the displacer is 90°. The power piston 120 is provided with sealing rings 122 and is connected to a piston rod 110 which slides through a mounting plate 116 by way of a seal 118. Similarly, the displacer 121 is connected to a displacer rod 111 and the displacer is provided with sealing rings 123 and the displacer rod slides in a mounting plate 117 through a seal 119.

A first crank-shaft 102 is rotatably mounted in bearings in the crank-case and is connected by suitable gears to a second crank-shaft 103, also rotatably mounted in bearings in the crank-case and orientated parallel to the first crank-shaft 102. The crank-shafts are geared together by gear wheels 104 and 105 so that the second crank-shaft rotates at twice the speed of the first crank-shaft.

The piston rod 110 is connected to an off-set crank 112 on the first crank-shaft by way of a connecting rod 107. The displacer rod 111 is pivotally connected to an intermediate point on a yoke 106 which has one end pivotally connected to a connecting rod 108 which is in turn connected to the off-set crank 112 and the other end pivotally connected to a connecting rod 109 which is in turn connected to an off-set crank 113 on the second crank-shaft 103. In the preferred form of the invention the displacer rod is connected to the yoke 106 by way of pivot point 142 at a point one-third of the distance along the yoke from the end 140, and two-thirds from the opposite end 141.

The cylinders 114 and 115 are provided with manifolds 130 and 131 respectively which have ports 150 and 151 opening to the cylinders. The manifolds are interconnected by a conduit 134 from the manifold 130 to a radiator 138 by way of inlet 136 and then by way of radiator outlet 137 through conduit 135 to the displacer manifold 131. The radiator is designed to dissipate heat from the fluid as will be described further later.

The upper end of the cylinder 114 is provided with a cylinder head 124 which incorporates a conduit 143 leading to a regenerator 128. A heater 127 is provided within the cylinder head 124 which is provided with heat from a source of combustion or from any other convenient external heat source to heat the working fluid passing through conduit 143. The regenerator 128 is arranged to store heat from the working fluid passing from the cylinder 114 to cylinder 115 and then to give up that heat to fluid passing in the opposite direction so as to preheat the working fluid passing to the heater 127. The regenerator 128 is in turn connected by way of a conduit 126 to a cooler 129 which is shown separately for convenience but which may also be incorporated into the cylinder head of the displacer cylinder 115. The cooler 129 is in turn connected through the cylinder head 125 into the upper end of the cylinder 115.

In use the engine is charged with a suitable working fluid through connection 139 into the radiator 138 so that the fluid may be heated and cooled and expanded and contracted to achieve the working of the engine on the Stirling cycle.

Although the engine has been described with a single piston and a single displacer it will be appreciated that multiple pistons and displacers may be ganged in line on the crank-case 101 to achieve a more powerful engine if desired.

The cylinder 115 may optionally be provided with a floating valve 144 to more closely approach the working of the theoretical Stirling cycle. The valve 144 is lifted by the force of the working fluid during the compression stroke of the displacer piston 121. The working fluid may enter the cylinder 115 through port 145 during the fluid reverse stroke.

The operation of the engine as described above will now be described with particular reference to FIGS. 2 and 3 of the accompanying drawings.

Figure 2:
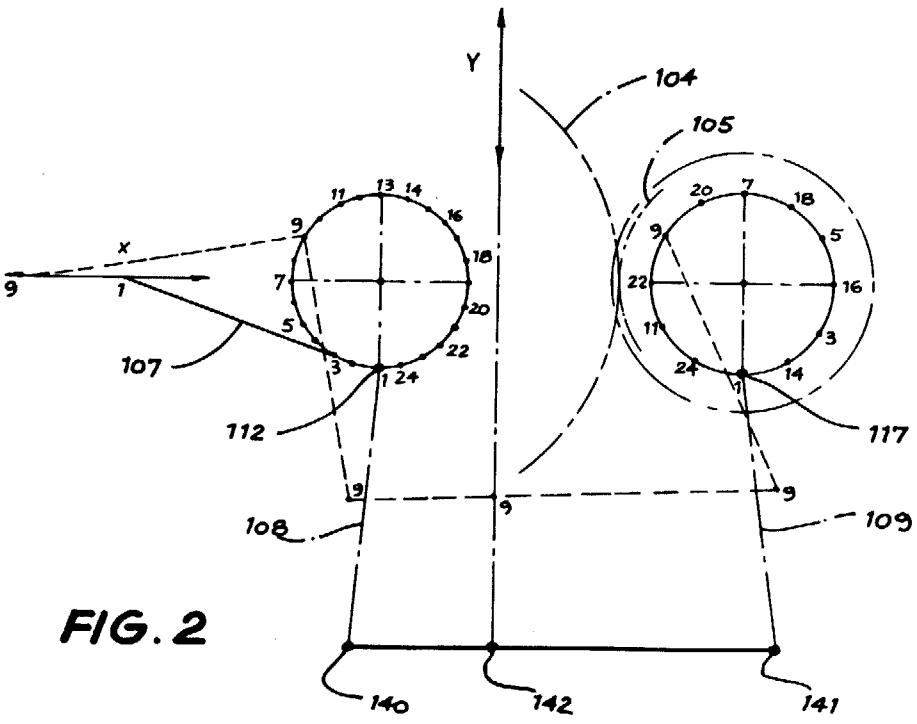
FIG. 2 is a chart showing the positions of various points in the crank linkage of the engine shown in FIG. 1 at given points in rotation of the engine.

In FIG. 2 the rotational position of crank-shaft 102 is shown by numbers 1 to 24 equally spaced around the periphery of the crank-shaft and the relative position of the second crank-shaft 103 is shown by like numbers arranged around the periphery of that crank-shaft. It will be appreciated that as crank-shaft 103 rotates at twice the speed of crank-shaft 102 the numbers on the periphery of crank-shaft 103 describe two complete rotations. The position of the linkage points 140, 141 and 142 are also shown in FIG. 2 at various points in the operating cycle of the engine and are labelled with the numbers corresponding to the indexed rotational numbers 1 to 24 on the first crank-shaft 102. FIG. 3 shows the relative displacement of the piston over movement X in the upper part of the graph and the relative displacement of the displacer over movement Y in the lower part of the graph.

The horizontal axis of the graph is graduated in equispaced graduations numbered 1 to 24 and corresponding with the rotational graduations on the first crank-shaft 102 shown in FIG. 2. The portion of the movement of the piston during which the outlet port is exposed is shown at 150 and the portion of movement of the displacer at which the inlet port is exposed is shown at 151. It will be seen that at position 1 with the yoke 106 in the position as shown in FIG. 1 the piston is midway through rising in the cylinder 114 and the displacer is at the lowest point of its movement with the port 133 open as shown at 151. Upward movement of the piston continues to position 7 at which point the displacer is moving upwardly in cylinder 115 until its uppermost point is reached at position 9. The vertical distance between the upper graph for the piston and the lower graph for the displacer shown in FIG. 3 corresponds to the volume of the regenerator 128, the cooler 129 and the duct 126. The linkage 142 acts to hold the displacer at or near the upper end of the cylinder 115 during the cycle phases numbered 9 to 18 while the piston is driven downwardly in the power stroke by the expansion of the working gases heated by the heater 127. At position 19 the outlet port 150 in the cylinder 114 is opened by movement of the piston allowing the working fluid to pass through the conduit 134 into the radiator 138 for cooling and thence to the inlet port 151 of the displacer which is opened at position 1. The piston and the displacer are moving in opposite directions between positions 18 and 24 so that the working fluid is readily transferred through the system in this part of the cycle. In the preferred form of the invention shown and described above the stroke of the displacer is 85% of the stroke of the piston.

Although the engine has been described with an angle of 90° between the reciprocating axis of the piston and the reciprocating axis of the displacer this angle may be varied to achieve different effects. By increasing the angle between the piston and the displacer the compression ratio is decreased which will result in a decrease in the speed of the engine. It is possible to build an engine (preferably on a circular section crank-case) in which the angle between the piston and the displacer may be altered during operation of the engine up to an angle of 135° between the piston and the displacer to govern the speed of the engine to lower the compression ratio. At an angle of 135° the engine can operate down to very low speeds. Because of the geometry of the linkage the displacer remains fixed relative to the crank-case and the piston and cylinder 114 are rotated on the crank-case to change the angle between the piston and the displacer. This movement may also be used to stop the engine once the angle has been moved beyond 135°.

Various other proportions in the engine may also be altered, for example, the position of the pivot point 142 on the yoke 106 may be changed from the desired 2:1 ratio. It has been found, however, that this ratio on the yoke gives a superior performance of the engine.

Figure 3:
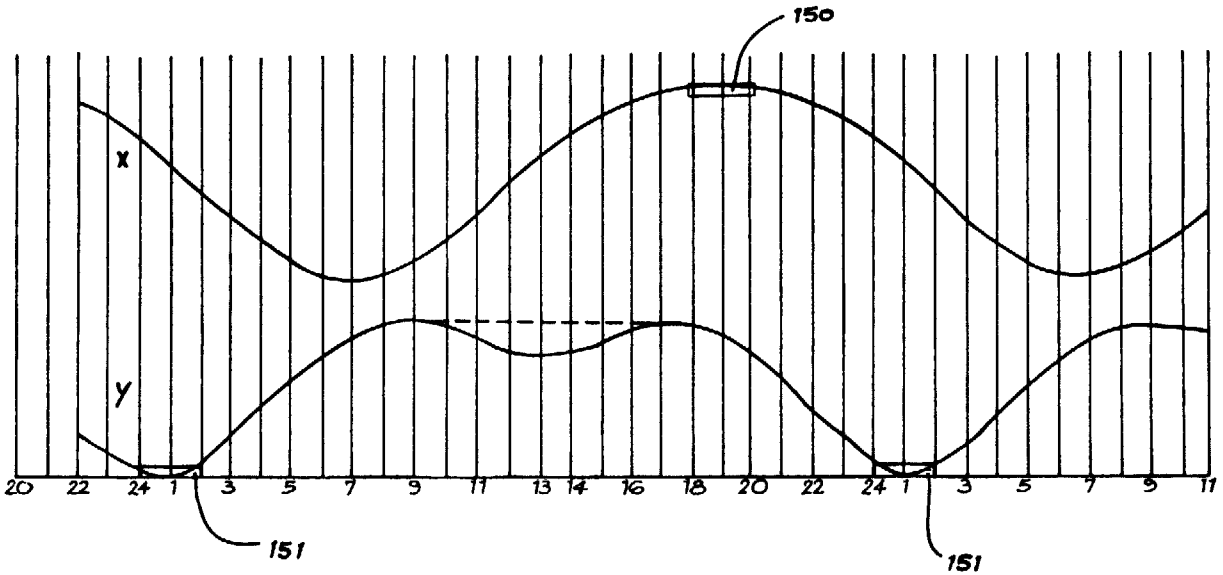
FIG. 3 is a graph of the relative displacement of the power piston and the displacer of an engine according to the invention at the given points of rotation shown in FIG. 2.

Because of the linkage employed it has been possible to hold the movement of the displacer substantially stationary at the upper end of its stroke over the operational positions 9 to 18 shown in FIGS. 2 and 3.

The dip in the graph between the positions 9 and 18 may be removed or lessened by the optical floating valve 144 in the displacer cylinder 115. Use of this valve has the effect of approximating the dotted line shown in the graph in FIG. 3. This has the added advantage that the ideal Stirling cycle may be closely approached giving a highly efficient operation of the engine. The use of the radiator 138 in conjunction with the close approach to the ideal Stirling cycle enables many advantages to be achieved. The timing of the Stirling cycle allows the power stroke to be much more powerful than that achieved by previous external combustion engines due to the displacer being held stationary during the power stroke. The timing of the Stirling cycle makes the use of a single radiator 138 possible with simple inlet and outlet ports in the cylinders operated by movement of the piston and the displacer.

The charging of the engine with working fluid is very simple through a single connection 139 as the entire fluid storage system and the radiator are interconnected.

As the engine has first and second crank-shafts 102 and 103, one of which operates at twice the speed of the other, it is very easy to connect a simple gear box to the engine allowing a wide variety of drive speeds and torques.

Figure 4:
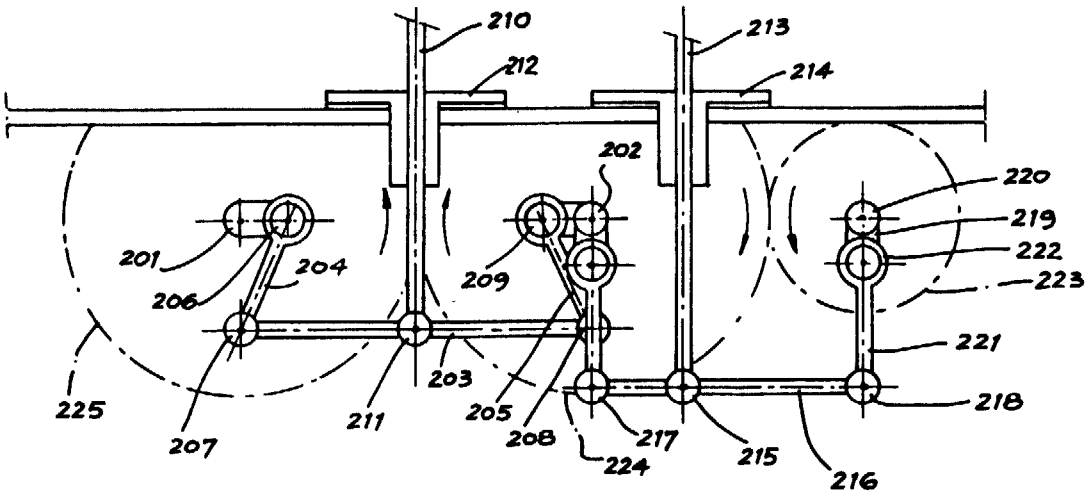
FIG. 4 is a diagrammatic side view of the crank linkage of a heavy-duty variation of the engine shown in FIG. 1.

Although the engine has been described in one form as shown in FIG. 1 it is of course possible to build this engine in many other configurations. For example a heavy-duty engine may be constructed utilising the crank-shaft mechanism shown in FIG. 4. In this form the power cylinder and the displacer cylinders are both mounted on the crank-case with their axes parallel and the power from the expanding fluid is transmitted to two crank-shafts 201 and 202. These crank-shafts are connected by a yoke 203 and connecting rods 204 and 205 through pivot pins 206, 207, 208 and 209. The power piston is connected to piston rod 210 which drives the yoke 203 through a pivot pin 211. The piston rod is supported and guided by a bush 212.

The displacer piston is driven by a displacer rod 213 guided and supported in a bushing 214. The displacer rod is driven by a pivot pin 215 at the two-thirds linkage point in the yoke 216 supported between pivot pins 217 and 218. The constant 90° phase shift between the power piston and the combined movement of the displacer has been accomplished by using an offset crank 209 mounted on a jack shaft 202 and arranged to reciprocate the pivot pin 218 through a connecting rod 221 driven by a pivot pin 222. Shaft 220 is driven at twice the speed of the drive shaft by way of connecting gears 223 and 224. The gear 224 also meshes with an identical gear 225 on the other crank-shaft 201.

The remaining details of the power piston and displacer piston and cylinders are the same as for the engine shown in FIG. 1.

Figure 5:
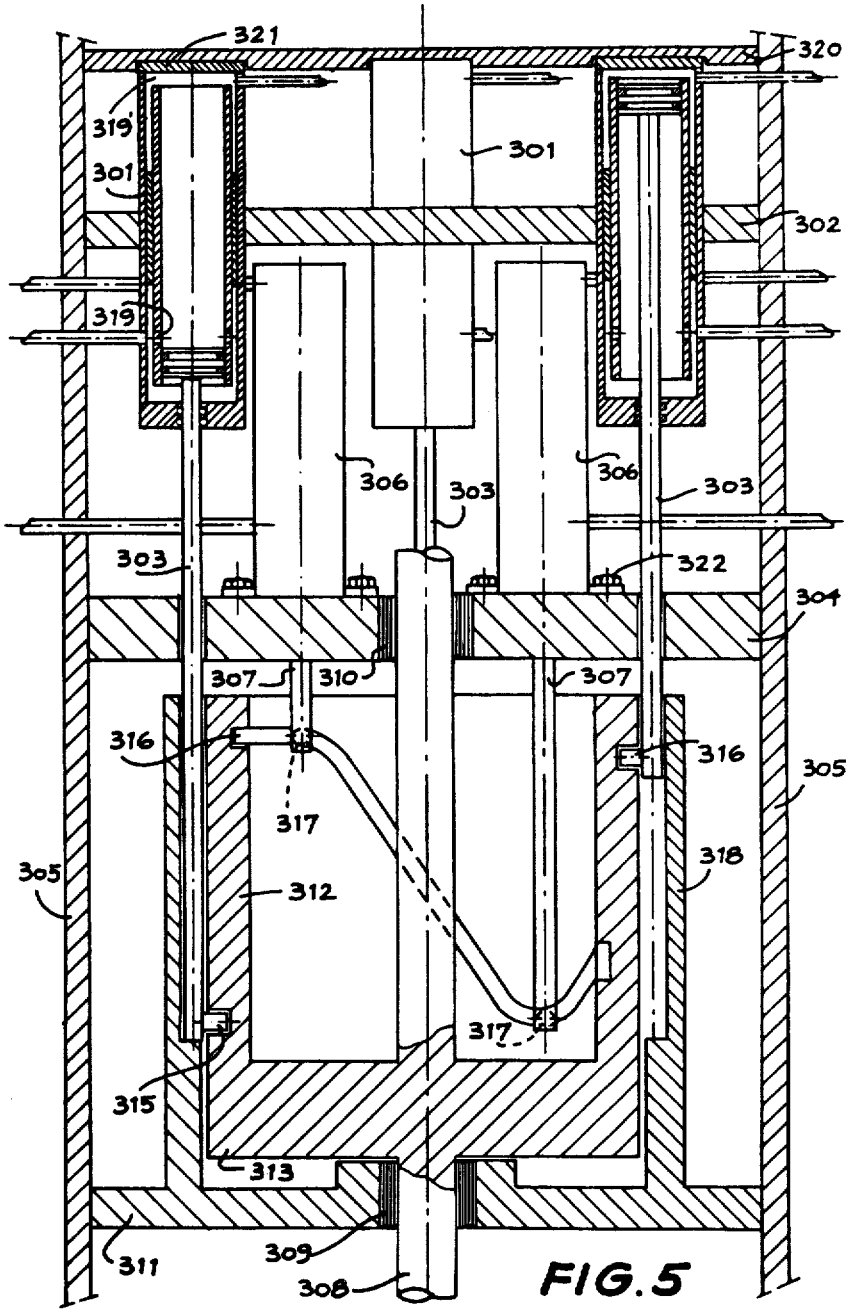
FIG. 5 is a diagrammatical cross-sectional elevation of an alternative form of Stirling cycle engine according to the invention.

In a further form of the invention as shown in FIG. 5, the crank-shaft and connecting rod linkage is replaced by a cam cylinder which enables a cam profile to be utilised to give any desired relative movement between the power and displacer pistons.

In this form of the invention four power cylinders 301 are provided arranged so as to be equispaced on a pitch circle when seen in plan view. In FIG. 5 two of the power cylinders are shown in cross-section and the third in diagrammatic block elevation. The power cylinders are supported by a horizontal supporting wall 302 so that the piston rods 303 protrude downwardly and pass through bushings in a further horizontal support wall 304. The support walls 302 and 304 are held in a suitable frame 305.

Figure 6:
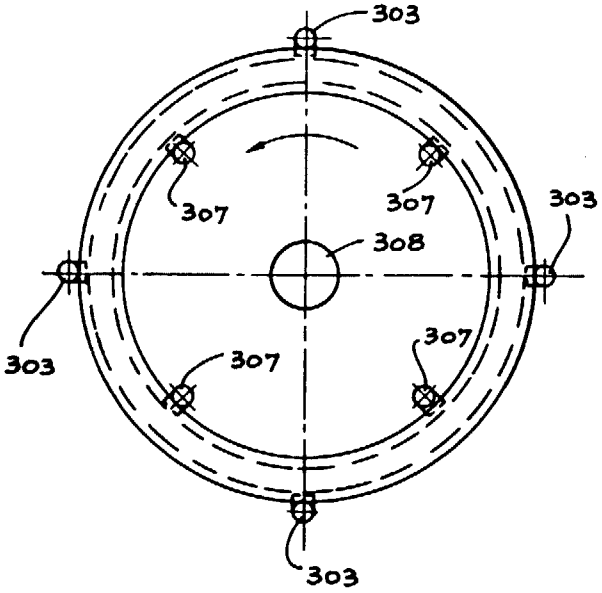
FIG. 6 is a partial horizontal cross-section of the cam cylinder of the engine shown in FIG. 5.

Four displacer cylinders 306 are provided equispaced around a smaller pitch circle than that for the power cylinders and arranged so that each displacer cylinder is equispaced between a pair of power cylinders. The displacer cylinders are provided with displacer rods 307 extending downwardly therefrom through the support wall 304. The displacer cylinders are mounted on the support walls by way of flanges 308. The relative positions of the power cylinders and the displacer cylinders in a horizontal plane may be clearly seen with reference to FIG. 6 which shows the positioning of the piston rods 303 and the displacer rods 307.

The engine is provided with a drive shaft 308 mounted in suitable bearings 309 and 310 in support walls 311 and 304 respectively. The drive shaft is driven by a cam cylinder 312 which has a lower radial flange 313 and a cylindrical wall 314 having an outer cam track 315 and an inner cam track 316.

The outer cam track is arranged to be engaged with and driven by cam followers 317 at the lower end of the piston rods 303. The inner cam track 316 is arranged to drive cam followers at the lower end of the displacer rods 307.

In order to provide additional support to the lower end of the piston rods 303 a cylindrical wall 318 is provided supported by the support wall 311 and surrounding the cam cylinder 312. The support wall is provided with inner grooves parallel to the drive shaft 308 which form a sliding support for the lower end of the piston rods 303.

The power cylinder and displacer cylinders are provided with inlet and outlet ports such as those shown at 319 in a similar manner to the engine shown in FIG. 1 and these ports are interconnected through a heater, radiator, regenerator and cooler in a similar manner.

Figure 7:
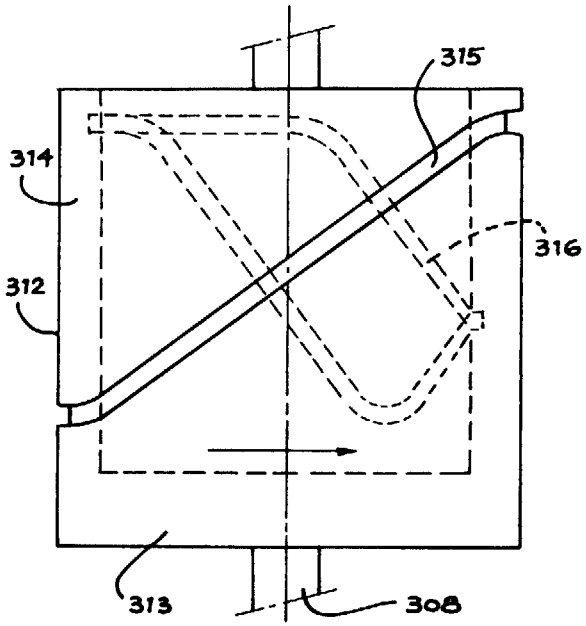
FIG. 7 is a diagrammatical side view of the cam cylinder shown in FIG. 6
Figure 8:
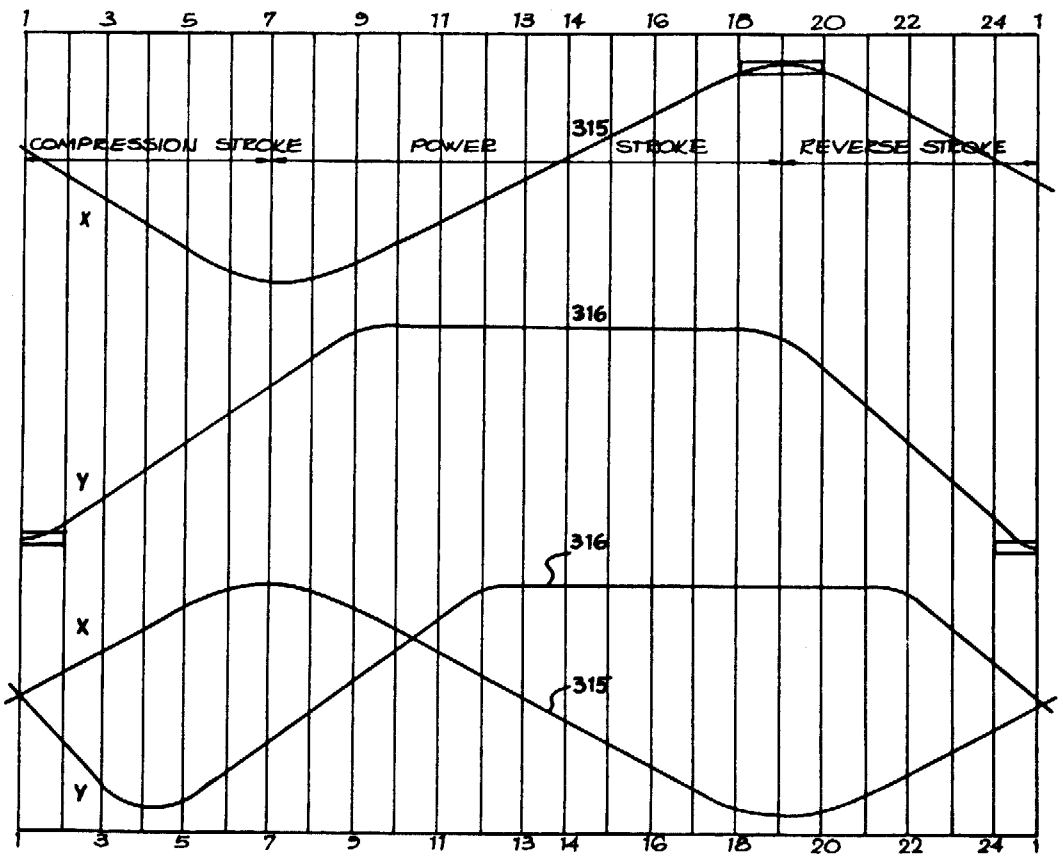
FIG. 8 is a graph of the relative displacement of the power piston and the displacer of the engine shown in FIG. 5 at various points in the cycle of rotation of the engine.

The advantage of the form of the engine shown in FIG. 5 is that the designer may obtain the desired relative movement between the power piston and the displacer piston by designing the profile of the tracks 315 and 316. These cam tracks are shown in FIG. 7 and their profile may more clearly be seen by reference to FIG. 8. FIG. 8 is a graph in which the horizontal axis is divided into 24 equal increments of rotation of the drive shaft of the engine in a similar manner to the graph shown in FIG. 3 for the engine of FIG. 1.

The lower part of the graph in FIG. 8 shows the profile of the cam track of the cam cylinder "unwrapped" and superimposed one over the other. The part of the inner cam track which is followed by the displacer rods is shown at 401 and the part of the outer cam track which is driven by the piston rods is shown at 402. As the corresponding power cylinder and displacer cylinder are circumferentially offset in the engine, the phase of the two graph lines has been changed in the upper part of FIG. 8 to show the true relationship between the movement of the power piston and the movement of the corresponding displacer piston. In this manner other upper part of FIG. 8 shows for the engine of FIG. 5 the corresponding pattern as is shown in FIG. 3 for the engine of FIG. 1. It will be seen by comparing the upper part of FIG. 8 with FIG. 3 that in the engine shown in FIG. 5 it has been possible to achieve a relationship between the movement of the power piston and the movement of the displacer which follows the ideal Stirling cycle. In particular the movement of the displacer is able to be kept steady between positions 9 and 19 and the movement of the power piston is able to be kept linear over the power stroke and the compression stroke.

The engine configuration shown in FIG. 5 also has the advantage that it is an extremely compact engine. The particular arrangement also enables the uppermost supporting wall 320 to be used as a "hot wall" for providing heat to the cylinder heads 321. This layout permits very efficient and compact use to be made of the external heat source.

In using engines of these types all the other theoretical advantages of the Stirling cycle engine such as the use of cheap fuels and complete burning due to external combustion resulting in improved efficiency and lower pollution are achieved.

What we claim is:

1. A Stirling cycle engine having at least one power piston reciprocating in a cylinder and at least one displacer piston reciprocating in a cylinder, heating means located at or adjacent the upper end of the power cylinder, a first conduit connecting the upper ends of the power cylinder and the displacer cylinder, and wherein the walls of each cylinder are provided with ports which are uncovered by movement of the piston therein toward the bottom end of the piston stroke, the ports of the power piston cylinder being connected to the ports of the displacer cylinder by a second conduit incorporating cooling means arranged to cool the working fluid passing through said conduit.

2. A Stirling cycle engine as claimed in claim 1 wherein the first conduit incorporates a regenerator adjacent the power cylinder to take heat from working fluid passing out of said power cylinder and to preheat working fluid passing into said power cylinder, and a cooler adjacent the displacer cylinder.

3. A Stirling cycle engine as claimed in either claim 1 or claim 2 wherein said cooling means in said second conduit comprise a radiator.

4. A Stirling cycle engine as claimed in claim 1 wherein said first conduit is connected to said displacer cylinder by way of ports in the cylinder wall which are uncovered by the displacer piston at a point just below the top of the piston stroke.

5. A Stirling cycle engine as claimed in claim 4 wherein a one way valve is provided in the upper end of the displacer cylinder arranged to allow working fluid to pass from the displacer cylinder through the one way valve to the first conduit at the upper end of the displacer piston stroke but to prevent fluid flow therethrough in the reverse direction.

6. A Stirling cycle engine as claimed in claim 1 wherein the displacer piston is held in the upper part of the displacer cylinder while the power piston is displaced downwardly.

7. A Stirling cycle engine as claimed in claim 6 wherein the reciprocating axes of the power piston and the displacer are arranged in a V-configuration on a common crank-case incorporating a first crank-shaft and a second parallel crank-shaft geared to rotate at twice the speed of said first crank-shaft, said piston being connected to said first crank-shaft by a connecting rod to an off-set crank thereon and said displacer being connected to an intermediate point on a yoke having one end connected to a crank on said first crank-shaft and the other end connected to a crank on said second crank-shaft.

8. A Stirling cycle engine as claimed in claim 7 wherein said intermediate point is one-third of the length of said yoke from the end connected to the crank on said first crank-shaft.

9. A Stirling cycle engine as claimed in claim 6 wherein said power piston and said displacer are reciprocated by cam means.

10. A Stirling cycle engine as claimed in claim 9 wherein a plurality of power cylinders are provided having parallel reciprocating axes arranged on a first pitch circle and a plurality of displacer cylinders are provided having parallel reciprocating axes arranged on a second pitch circle concentric with said first pitch circle, and wherein said cam means comprise a cam cylinder having an axis of rotation concentric with said pitch circles and incorporating cam tracks on the inner and outer peripheral faces thereof arranged to operate said power and displacer pistons.

11. A Stirling cycle engine as claimed in claim 10 wherein said power pistons rotate said cam cylinder via connecting rods coupled to cam followers engaged with a cam track on the outside periphery of said cam cylinder, and said displacer pistons are operated by connecting rods coupled to cam followers engaged with a cam track on the inside periphery of said cam cylinder.

* * * * *